US008337260B2

(12) United States Patent
Lindström

(10) Patent No.: US 8,337,260 B2
(45) Date of Patent: Dec. 25, 2012

(54) METHODS FOR FACILITATING CONNECTION TO A BATTERY AND RELATED DEVICES

(75) Inventor: Anders Lindström, Sollentuna (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 13/129,905

(22) PCT Filed: Nov. 20, 2008

(86) PCT No.: PCT/SE2008/051331

§ 371 (c)(1), (2), (4) Date: May 18, 2011

(87) PCT Pub. No.: WO2010/059086

PCT Pub. Date: May 27, 2010

(65) Prior Publication Data

US 2011/0230084 A1 Sep. 22, 2011

(51) Int. Cl.
*H01R 4/30* (2006.01)

(52) U.S. Cl. ..... 439/755

(58) Field of Classification Search ..... 439/755, 439/763, 957, 628

See application file for complete search history.

(56) References Cited

U.S. PATENT DOCUMENTS

| | | | | |
|---|---|---|---|---|
| 3,783,439 | A * | 1/1974 | Valentino | 439/627 |
| 4,560,229 | A * | 12/1985 | Benton | 439/754 |
| 5,645,448 | A | 7/1997 | Hill | |
| 6,162,098 | A * | 12/2000 | Cheng et al. | 439/620.29 |
| 6,165,020 | A * | 12/2000 | Cheng et al. | 439/620.31 |
| 2003/0198867 | A1 | 10/2003 | Kim | |
| 2010/0273365 | A1 * | 10/2010 | Taguchi et al. | 439/770 |

FOREIGN PATENT DOCUMENTS

| | | | |
|---|---|---|---|
| DE | 856473 | C | 11/1952 |
| EP | 1239506 | A2 | 9/2002 |
| EP | 1355368 | A2 | 10/2003 |
| EP | 1526609 | A1 | 4/2005 |

OTHER PUBLICATIONS

IPRP, PCT/SE2008/051331, May 24, 2011.

Written Opinion, PCT/SE2008/051331, Jul. 10, 2009.

Office Action, European Patent Application No. 08 878 306.1, Apr. 25, 2012.

* cited by examiner

*Primary Examiner* — Phuong Dinh

(74) *Attorney, Agent, or Firm* — Myers Bigel Sibley & Sajovec

(57) ABSTRACT

Devices are provided for facilitating connection of at least one element to a pole of a battery. The devices include an adapter including a first portion of the adapter and a second portion of the adapter. The first portion of the adapter is configured to attach to the pole of the battery and the second portion of the adapter includes at least one protruding member. The at least one protruding member is configured to receive the at least one element and is electrically connected to the first portion of the adapter. The device further includes a protective lid configured to be received by the adapter and to provide an electrically insulating cover for the at least one protruding member.

20 Claims, 3 Drawing Sheets

METHODS FOR FACILITATING CONNECTION TO A BATTERY AND RELATED DEVICES

CROSS-REFERENCE TO RELATED APPLICATION

This application is a 35 U.S.C. §371 national stage application of PCT International Application No. PCT/SE2008/051331, filed on Nov. 20, 2008, the disclosure and content of which are incorporated by reference herein as if set forth in its entirety. The above-referenced PCT International Application was published in the English language as International Publication No. WO 2010/059086 A1 on May 27, 2010.

FIELD

The present invention relates in general to the field of electrical engineering, and more particularly to the part of this field that is concerned with providing simple and efficient electrical connections to batteries.

BACKGROUND

In many technical applications one or more batteries are used in order to provide a supply of power. Often, when several batteries are used, the batteries are stacked on top of each other in order to save space. The batteries include battery poles, which are often located on the top of the batteries. Frequently, cables or other elements have to be connected to the battery poles. This can in many cases, in particular when the batteries are stacked on top of each other, be a fairly difficult task. This applies especially when, for instance, several cables have to be attached to the same battery pole.

A problem addressed by the present invention is therefore to be able overcome or at least mitigate the above-indicated difficulties.

SUMMARY

According to one aspect of the present invention, the above-stated problem is solved with a device for facilitating connection of one or more elements, e.g. cables, to a battery pole. The device includes an adapter. A first portion of the adapter is configured such that it can be attached to the battery pole. A second portion the adapter comprises at least one protruding member, which is configured such that it can receive one or more elements. The adapter is further configured such that there is an electrical connection between the at least one protruding member and the first portion of the adapter. The device further comprises a protective lid, which is configured to provide an electrically insulating cover around at least the protruding member. The invention includes also a method of using the above-described device.

One main advantage of the invention is that cables no longer have to be connected directly on the battery poles. Instead, cables can be attached at a different location, which may be more convenient, e.g. more accessible. For example, in a particular embodiment, the adapter may be configured such that cables can be attached to the adapter in front of the battery, rather than on top of the battery. This is of course highly advantageous in situations where batteries are stacked on top of each other. Another main advantage is provided by the protective lid, which greatly reduces a risk of an accidental short circuit being formed.

The person skilled in the art will appreciate that further objects and advantages may be associated with particular embodiments of the invention.

The invention will now be described further using exemplary embodiments and referring to the drawings.

DETAILED DESCRIPTION

Figure 1:
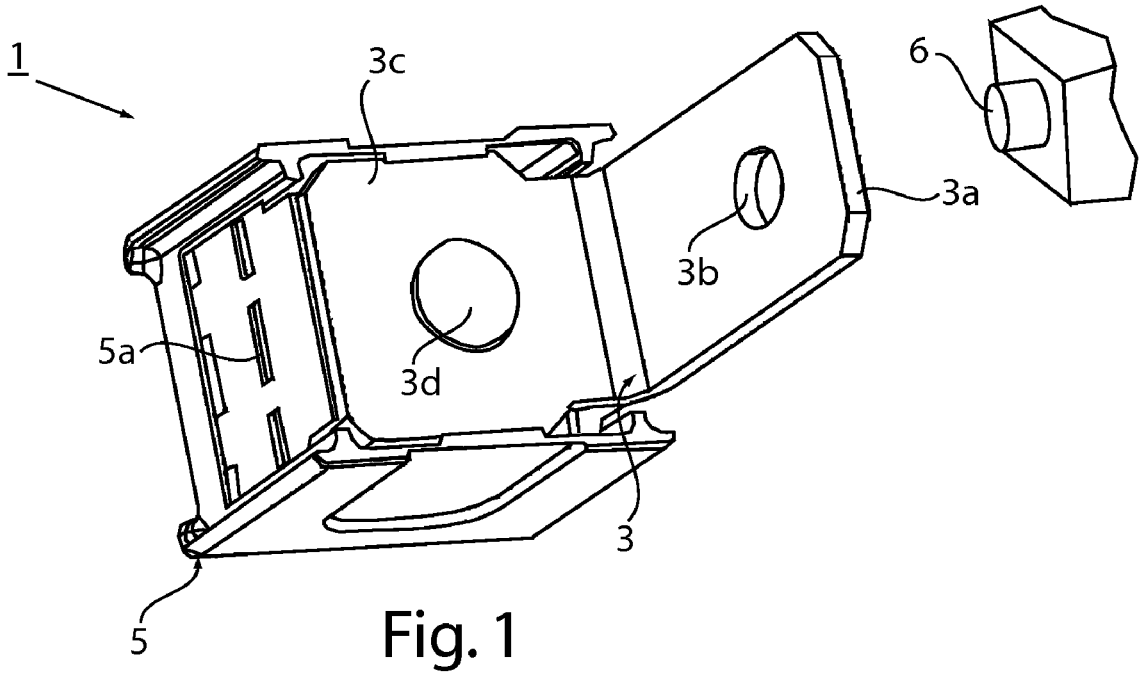
FIG. 1 is a perspective view of a device for facilitating connection of one or more cables to a battery pole in accordance with an embodiment of the invention.

FIG. 1 is a perspective view of a device 1 for facilitating connection of one or more cables to a battery pole in accordance with an embodiment of the invention. The device 1 comprises an adapter part 3 and a protective lid 5. The adapter 3 comprises a first portion 3*a*, which is adapted so that it can be attached to a pole 6 of a battery. In this exemplary embodiment, the first portion 3*a* is therefore configured to form a hole 3*b* having a shape and size that correspond to a shape and size of the battery pole 6. The adapter 3 further comprises a second portion 3*c*, which includes a protruding member having a length and a thickness that makes it suitable for receiving one or more cable ends, e.g. provided with cable lugs. In this exemplary embodiment, the protruding member is a metallic screw 3*d*. Alternatively, the device 1 may comprise more than one protruding member, e.g. in the form of metallic screws. In FIG. 1, only one end of the screw 3*d* is shown, and this end is riveted onto the second portion 3*c* of the adapter 3, thereby fastening the screw 3*d* to the rest of the adapter 3. As will be illustrated more clearly in later drawings, the screw 3*d*, however, extends outwardly on the other side of the second portion 3*c*, and here the protective lid 5 provides an electrically insulating cover around the screw 3*d*. In the particular embodiment of FIG. 1, the adapter 3 is formed from a metal plate that is bent at an essentially right angle. However, the angle of the bend does not have to be a right angle. The first adapter portion 3*a* is here located on one side of the bend, and the second adapter portion 3*c* is located on the other side of the bend. The metal in the adapter ensures that there is a good electrical connection between the screw 3*d* and the first adapter portion 3*a*, to which the battery pole is to be attached.

Figure 2:
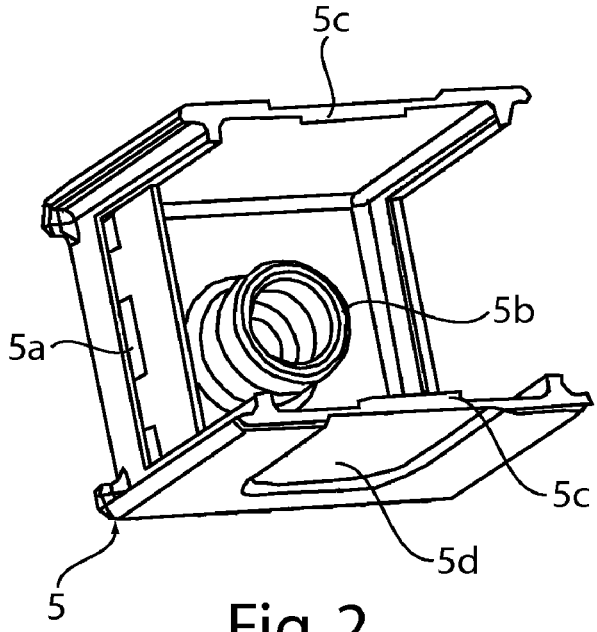
FIG. 2 is a perspective view of a protective lid of the device of FIG. 1.

The protective lid 5 is shown by itself in FIG. 2. In this exemplary embodiment, the lid has a box-like shape with four sides extending essentially perpendicularly from a fifth side. Two opposing sides are provided with flanges 5*c*, which allow the protective lid 5 to snap onto the adapter 3, as is illustrated in FIG. 1. These two sides are also each provided with a slight recess 5*d* which makes a middle portion of the side wall thinner and more flexible, hence facilitating the above-mentioned snap-on function. The other two opposing sides are provided with structural weakenings, here in the form of perforations 5*a*. The perforations 5*a* makes it possible to easily break off one or more portions of the protective lid 5 in order to provide one or more openings for the cables when the device 1 is to be used. In this exemplary embodiment, each perforated side comprises two rows of perforations 5*a* (see FIG. 1). Therefore, it is possible to break off one or two portions from each perforated side, so as to provide openings of different sizes. In FIG. 2, one portion has been broken off from one of the perforated sides, whereas two portions have been broken off from the opposing side (resulting in a larger opening). In the embodiment of FIG. 2, the fifth side is provided with a guide structure 5*b*, which is configured to fit on an end of the screw 3*d*. The guide structure 5*b* guides the protective lid 5 into place when the protective lid 5 is snapped onto the adapter 3. The guide structure 5*b* also increases a structural stability of the device 1, once the protective lid 5 has been mounted on the adapter 3.

Figure 3:
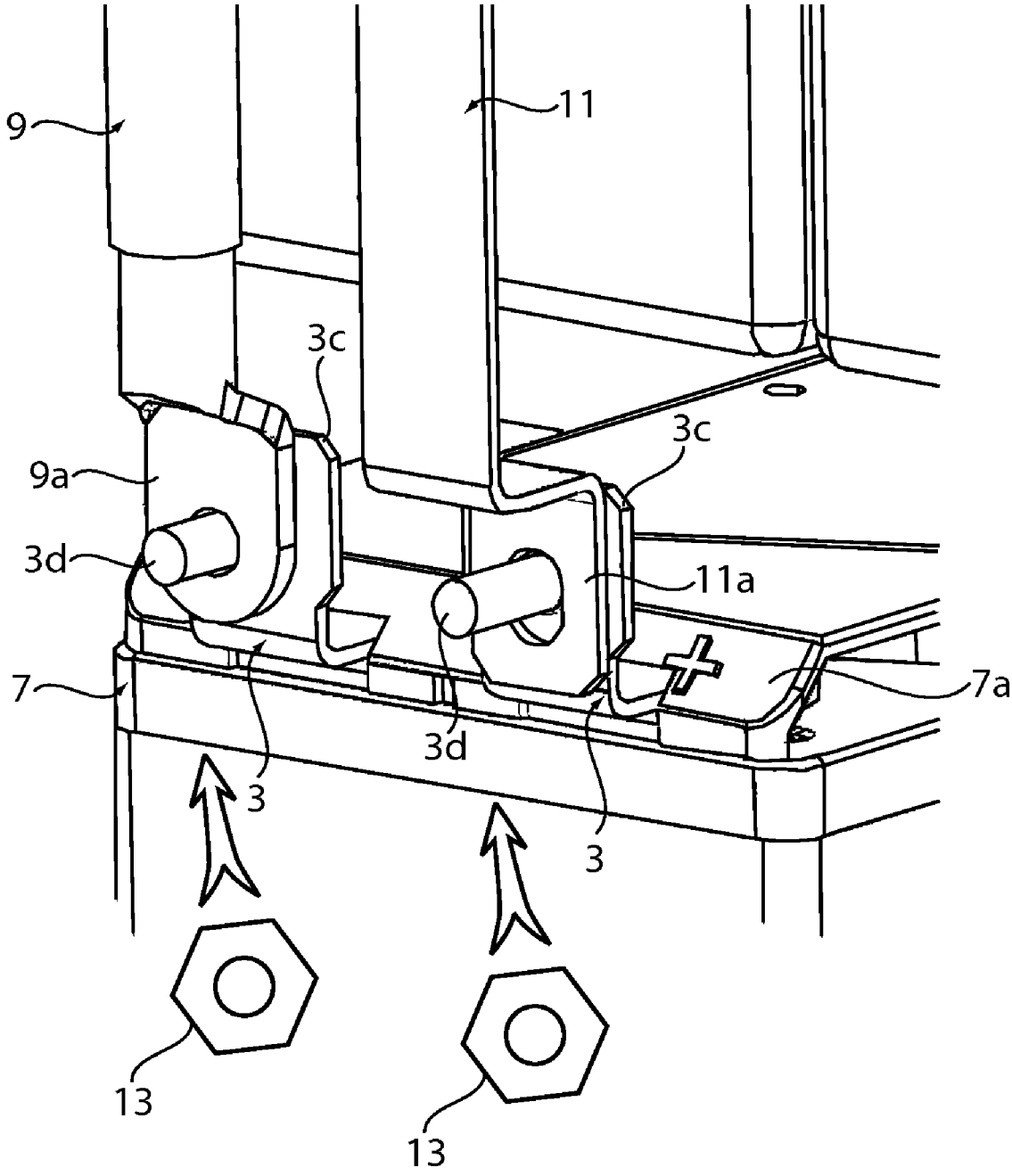
FIGS. 3 and 4 are perspective views illustrating use of the device of FIG. 1 for connection of cables to battery poles.

FIG. 3 is a perspective view illustrating how connection of cables to battery poles is facilitated by the above-described device 1. The figure shows two adapters 3, which each has been attached to a respective pole of a battery 7. Here, the battery 7 also includes a pole lid 7*a* which covers the battery poles. However, openings are provided in the pole lid 7*a* allowing the adapters 3 to reach the batter poles located under the pole lid 7*a*. For purpose of illustration, the adapters 3 are shown here without any protective lid 5. A flexible cable 9 is attached to the left adapter 3. In this exemplary embodiment, an end of the cable 9 is provided with a cable lug 9*a*, which is received by the screw 3*d* of the left adapter 3. The number of cables that can be received by the screw 3*d* is determined by the length of the screw 3*d*. A rigid cable 11 is attached to the right adapter 3. The rigid cable 11 is, here, basically a metal bar with end structures 11*a* similar to cables lugs. A middle portion, located between the ends 11*a*, of the rigid cable 11 is preferable covered with an electrically insulating material, such as a suitable form of plastic. The rigid cable 11 can of course be used independently of the device 1 and is therefore considered to constitute an invention in its own right. An end 11*a* of the cable 11 is received by the screw 3*d* of the right adapter. The cables 9 and 11 may be secured on the screws 3*d* by means of nuts 13 configured to fit on the screws; and one or more washers may also be provided to protect surfaces of the cable lugs 9*a*, 11*a* and the adapter 3. The length of the adapter screws 3*d* also makes it possible and easy to attach several cables to the same screw 3*d*. The adapters 3 make it possible to avoid having to attach the cables 9 and 11 directly on the battery poles. Instead, this can be done at a location that is more convenient, e.g. more accessible. Furthermore, an axis of the adapter screw 3*d* may have a direction which is different from that of an axis of the battery pole. For example, this allows the adapter 3 to be configured such that the cables can be attached from a side of the battery, instead of on the top of the battery, which is clearly advantageous if batteries are stacked on top of each other. In the example of FIG. 3, the adapter 3 is configured such that the cables 9 and 11 can be attached sideways in front of the battery. Several devices 1 can advantageously be used in conjunction with cables or other elements to provide electrical connections between different battery poles, e.g. to form series or parallel connections.

Figure 4:
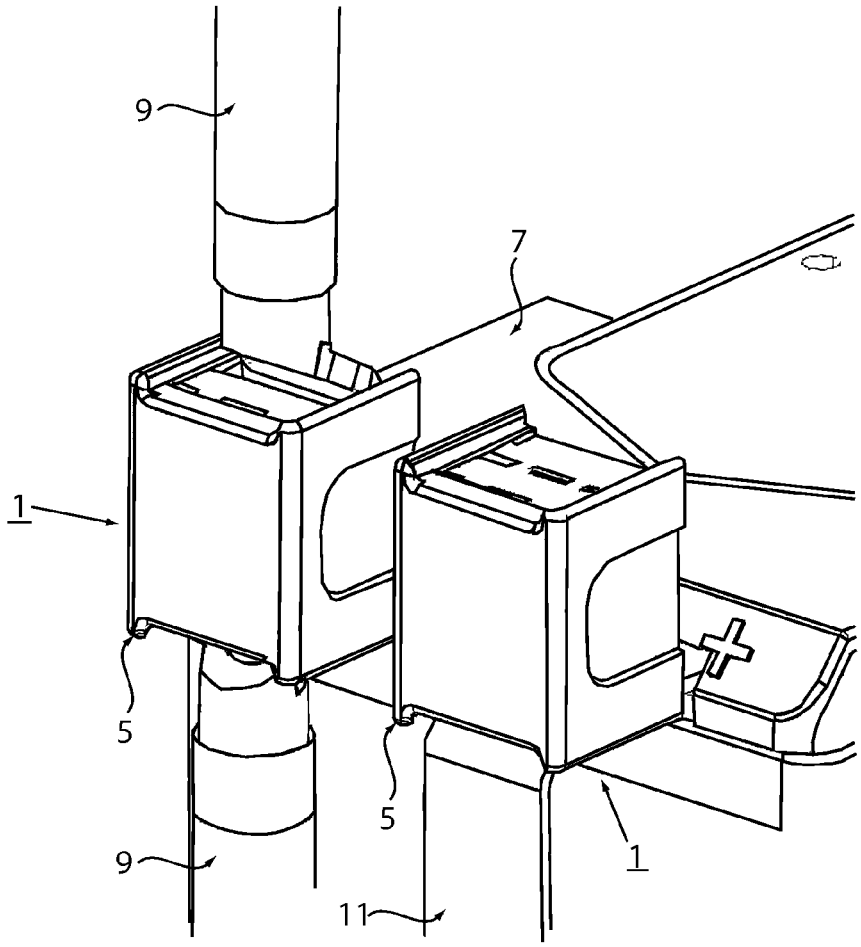

FIG. 4 is a similar view as the one in FIG. 3. Here, however, the devices 1 have been completed by providing the protective lids 5. FIG. 4 also illustrates how several (in this example two) cables 9 have been attached to one of the devices 1. The protective lids 5 are made of an electrically insulating material, e.g. a suitable form of plastic, and provide electrically insulating covers around the screws 3*d* and the cable ends. The protective lids 5 greatly reduce a risk of an accidental short circuit being formed.

Figure 5:
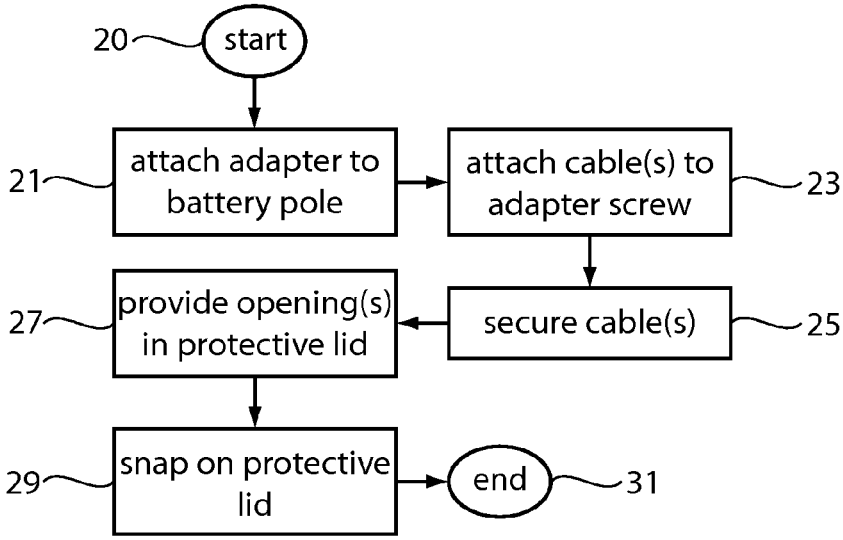
FIG. 5 is a flow chart illustrating a method according to an embodiment of the invention.

FIG. 5 is a flow chart illustrating a method of using the above-described device 1 according to an embodiment of the invention. After a start 20, the first portion 3*a* of the adapter 3 is attached to a battery pole at a block 21. Then, at a block 23, one or more cables are attached to the adapter screw 3*d* of the second portion 3*c* of the adapter 3. At a block 25, the one or more cables may be secured on the screw 3*d* by means of a nut or similar. One or more washers may also be provided for protecting the cables and/or the adapter 3. At a block 27, one or more openings are provided in the protective lid 5, having regard to the number of cables that have been attached to the adapter screw 3*d* at the block 23. As suggested above, the openings may be provided by breaking off one or more portions from the protective lid 5. The protective lid 5 is then snapped into place on the adapter 3 at a block 29, after which the method ends at a block 31.

The device 1 is of course not limited to connection of cables to a battery pole but can be used also to connect other elements, e.g. elements which have a function and/or design that is similar to that of a cable, but which do not strictly qualify as cables. The method illustrated in FIG. 5 can be used, mutatis mutandis, when connecting one or more such other elements to the battery pole.

Above, the invention has been illustrated with various embodiments. These embodiments are, however, intended only as non-limiting examples, and the scope of protection is instead defined by the appending claims.

The invention claimed is:

1. A device for facilitating connection of at least one element to a pole of a battery, the device comprising:

an adapter including a first portion of the adapter and a second portion of the adapter, the first portion of the adapter being configured to attach to the pole of the battery and the second portion of the adapter including at least one protruding member, wherein the at least one protruding member is configured to receive the at least one element and is electrically connected to the first portion of the adapter; and a protective lid configured to be received by the adapter, to provide an electrically insulating cover for the at least one protruding member and to remain in place during operation of the battery.

2. The device of claim 1, wherein the adapter comprises a metal plate, the metal plate being bent at an angle to provide the first portion of the adapter on a first side of the bent metal plate and the second portion-on a second side, different from the first side, of the bent metal plate.

3. The device of claim 2, wherein the angle of the bent metal plate is a right angle.

4. The device of claim 2, wherein the first portion of the adapter defines a hole, the hole being configured to receive the battery pole.

5. The device of claim 1, wherein the at least one protruding member comprises a screw.

6. The device of claim 5, wherein the screw is configured to receive a nut to secure the at least one element to the screw.

7. The device of claim 1, wherein the protective lid is configured to snap on to the adapter.

8. The device of claim 1, wherein the protective lid comprises a guide structure configured to be received on an end of the at least one protruding member.

9. The device of claim 1, wherein the protective lid comprises at least one weakened portion, such that the at least one weakened portion of the protective lid can be broken off or punctured to provide at least one opening in the protective lid.

10. The device of claim 9, wherein the at least one weakened portion is defined by perforations in the protective lid, the perforations defining a size and shape of the at least one opening.

11. A method for facilitating connection of at least one element to a battery pole, the method comprising:

attaching a first portion of an adapter to the battery pole;

attaching the at least one element to a protruding member of a second portion of the adapter; and arranging a protective lid on the adapter, the protective lid being configured to provide an electrically insulating cover for the protruding member and to remain in place during operation of the battery.

12. The method of claim 11:

wherein the protruding member comprises a screw; and wherein the method further comprises arranging a nut on the screw to secure the at least one element to the screw.

13. The method of claim 11, wherein the method further comprises removing at least one portion of the protective lid to provide at least one opening in the protective lid.

14. The method of claim 12, wherein the method further comprises removing at least one portion of the protective lid to provide at least one opening in the protective lid.

15. The method of claim 11, wherein the at least one element comprises a cable.

16. The device of claim 1, wherein the at least one element comprises a cable.

17. The device of claim 3, wherein the first portion of the adapter defines a hole, the hole being configured to receive the battery pole.

18. The device of claim 2, wherein the protective lid comprises a guide structure configured to be received on an end of the at least one protruding member.

19. The device of claim 2, wherein the protective lid comprises at least one weakened portion, such that the at least one weakened portion of the protective lid can be broken off or punctured to provide at least one opening in the protective lid.

20. The device of claim 19, wherein the at least one weakened portion is defined by perforations in the protective lid, the perforations defining a size and shape of the at least one opening.

* * * * *